US006082570A

United States Patent [19]

Tai

[11] Patent Number: 6,082,570

[45] Date of Patent: Jul. 4, 2000

[54] FOLDABLE BOX ASSEMBLY

[76] Inventor: Daniel Tai, 4519 Hatch La., Lisle, Ill. 60532-4360

[21] Appl. No.: 09/270,667

[22] Filed: Mar. 16, 1999

[51] Int. Cl.[7] ..... A45C 7/00; B65D 6/12; B65D 6/18; B65D 6/26

[52] U.S. Cl. ..... 220/6; 220/7; 220/8; 220/4.28; 220/9.2

[58] Field of Search ..... 220/6, 7, 8, 9.2, 220/9.3, 9.4, 4.28, 666, 668

[56] References Cited

U.S. PATENT DOCUMENTS

| | | | |
|---|---|---|---|
| 608,998 | 8/1898 | Apthorp | 220/9.2 |
| 3,618,803 | 11/1971 | Dobberkau | 220/6 X |

FOREIGN PATENT DOCUMENTS

| | | | |
|---|---|---|---|
| 316450 | 10/1969 | Sweden | 220/8 |
| 2160851 | 1/1986 | United Kingdom | 220/660 |

*Primary Examiner*—Allan N. Shoap
*Assistant Examiner*—Joe Merek
*Attorney, Agent, or Firm*—Rosenberg, Klein & Lee

[57] ABSTRACT

A foldable box assembly includes a base plate, two first side plates, and two second side plates. The base plate has two opposite lateral sides provided with receiving chambers, respectively. The first side plates each have four sides. One side thereof is pivotally connected to two sides of the base plate. The second side plates are formed from a flexible material and are elastically wound up in the two receiving chambers of the base plate. The second side plates each have an upper end connected to an end rod. The end rod has two ends each being connected to one end of a link. The link has the other end pivotally connected to a free end of a respective one of the first side plates. A positioning mechanism is provided between the base plate and the first side plates, and is adapted for controlling the first side plates to be positioned in an assembled state or in an adjustable state. The first and second side plates can be erected or extended as needed to allow flexible adjustment of the depth of the box assembly so as to facilitate display or removal of articles in the box assembly or to facilitate carrying of the articles.

5 Claims, 5 Drawing Sheets

FOLDABLE BOX ASSEMBLY

BACKGROUND OF THE INVENTION (a) Field of the Invention

The present invention relates to a foldable box assembly, more particularly to a container having side plates that can be erected or extended to allow flexible adjustment of the depth of the container.

(b) Description of the Prior Art

With the rise in living standards, people pay more and more attention to leisure and recreational activities. Going to the countryside is a quite popular activity. When it is needed to place articles on the ground in the countryside or on the floor of the car, in order to prevent the articles from scattering or being contaminated, containers are used. However, the depth of ordinary containers is generally fixed and non-adjustable. If the container is too deep, the contents of the container cannot be displayed or removed with ease, and those at the bottom of the container is not visible. If the container is too shallow, the contents may fall out when it is being carried or moved.

SUMMARY OF THE INVENTION

A primary object of the present invention is to provide a foldable box assembly that can be erected or unfolded as desired to allow flexible adjustment of the depth of the box. The user can adjust the state of the box as needed. To facilitate displaying or removal of contents of the box, the box can be adjusted to become a shallow container. If the box is to be carried around, it can be adjusted to become a deep container to prevent its contents from falling out.

In order to achieve the above-mentioned object, a preferred embodiment of a foldable box assembly of the present invention includes a base plate, two first side plates, and two second side plates. The base plate has two opposite lateral sides provided with receiving chambers, respectively. The first side plates each have four sides. One side thereof is pivotally connected to two sides of the base plate. The second side plates are formed from a flexible material and are elastically wound up in the two receiving chambers of the base plate. The second side plates each have an upper end connected to an end rod. The end rod has two ends each being connected to one end of a link. The link has the other end pivotally connected to a free end of a respective one of the first side plates. A positioning mechanism is provided between the base plate and the first side plates, and is adapted for controlling the first side plates to be positioned in an assembled state or in an adjustable state. The first and second side plates can be erected or extended as needed to allow flexible adjustment of the depth of the box assembly.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

Figure 1:
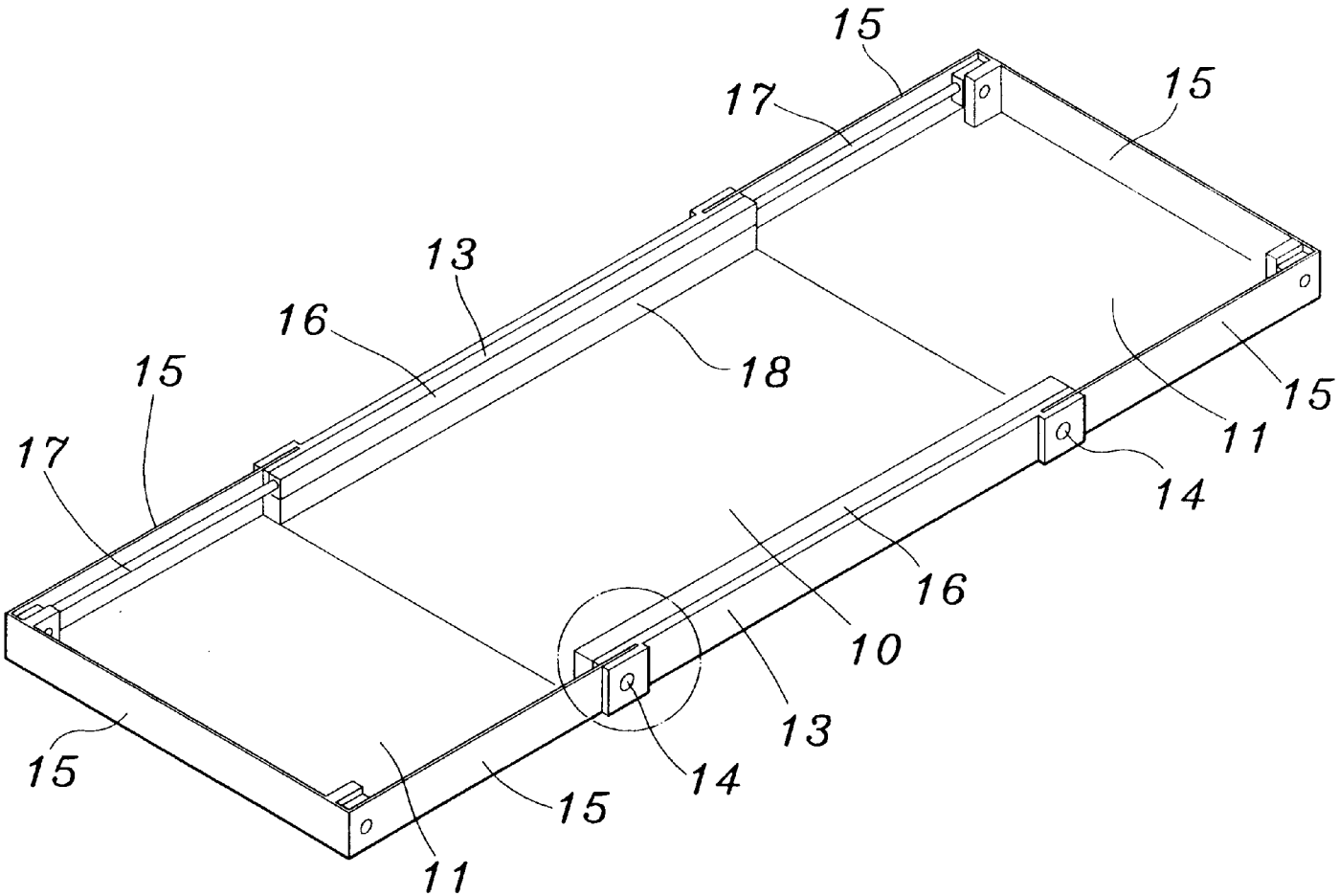
FIG. 1 is a perspective view of the present invention.
Figure 3:
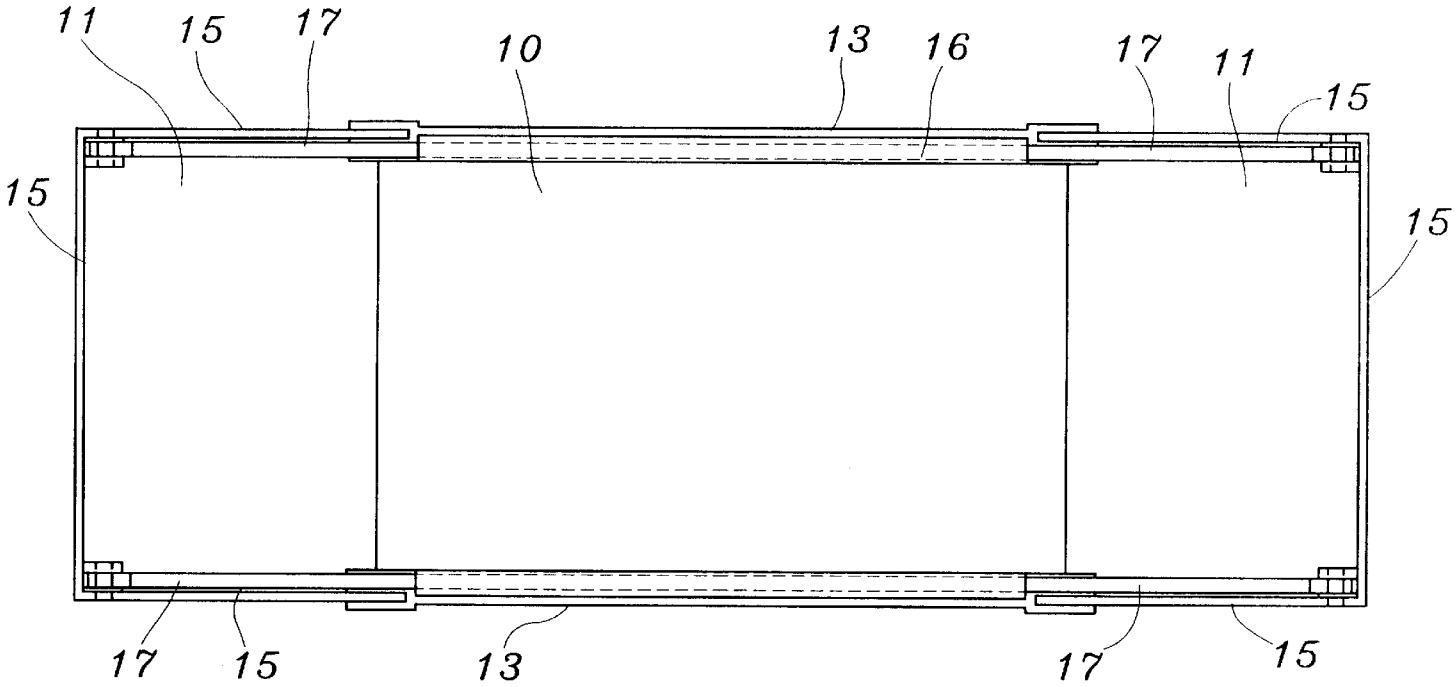
FIG. 3 is a top sectional view of the present invention.
Figure 2:
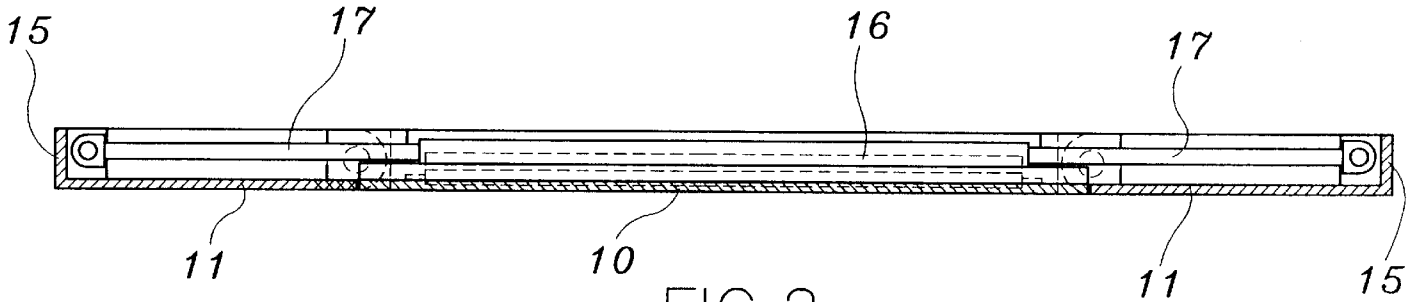
FIG. 2 is a front sectional view of the present invention.
Figure 8:
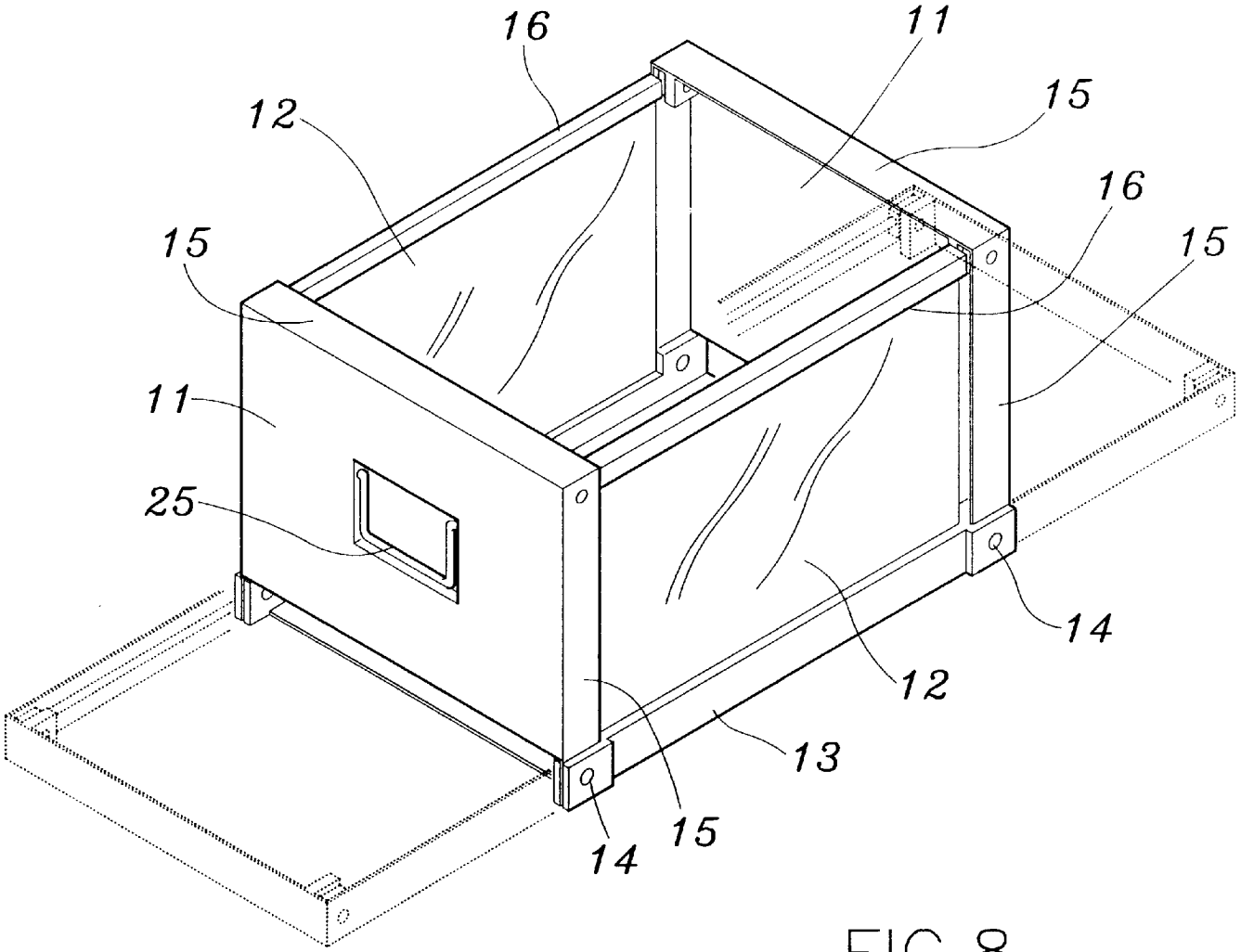
FIG. 8 is a schematic perspective view of the present invention in an assembled state.

With reference to FIGS. 1 to 3, a preferred embodiment of a foldable box assembly according to the present invention is shown to include a base plate 10, two first side plates 11, and two second side plates 12 (see FIG. 8). The base plate 10 is a substantially rectangular plate that has front and rear sides and two opposite lateral sides. Each of the lateral sides forms a flange 13. An inner side of the flange 13 has a receiving chamber 18 secured thereon for receiving a second side plate 12. The first side plates 11 are pivotally connected to front and rear sides of the base plate 10, respectively.

The first side plates 11 are substantially rectangular plates and have one side pivotally connected to the front and rear sides of the base plate 10 at both ends by pivot elements 14. The other three sides of the first side plates 11 form flanges 15. The first side plates 11 can pivotally displace using pivot elements 15 as fulcrums so that they can displace to an assembled state in which they are substantially perpendicular to the base plate 10 or to an extended state (see FIG. 8) in which they lie substantially level with respect to the base plate 10. A handle 25 may be provided on an outer side of the first side plate 11 to facilitate carrying.

Figure 7:
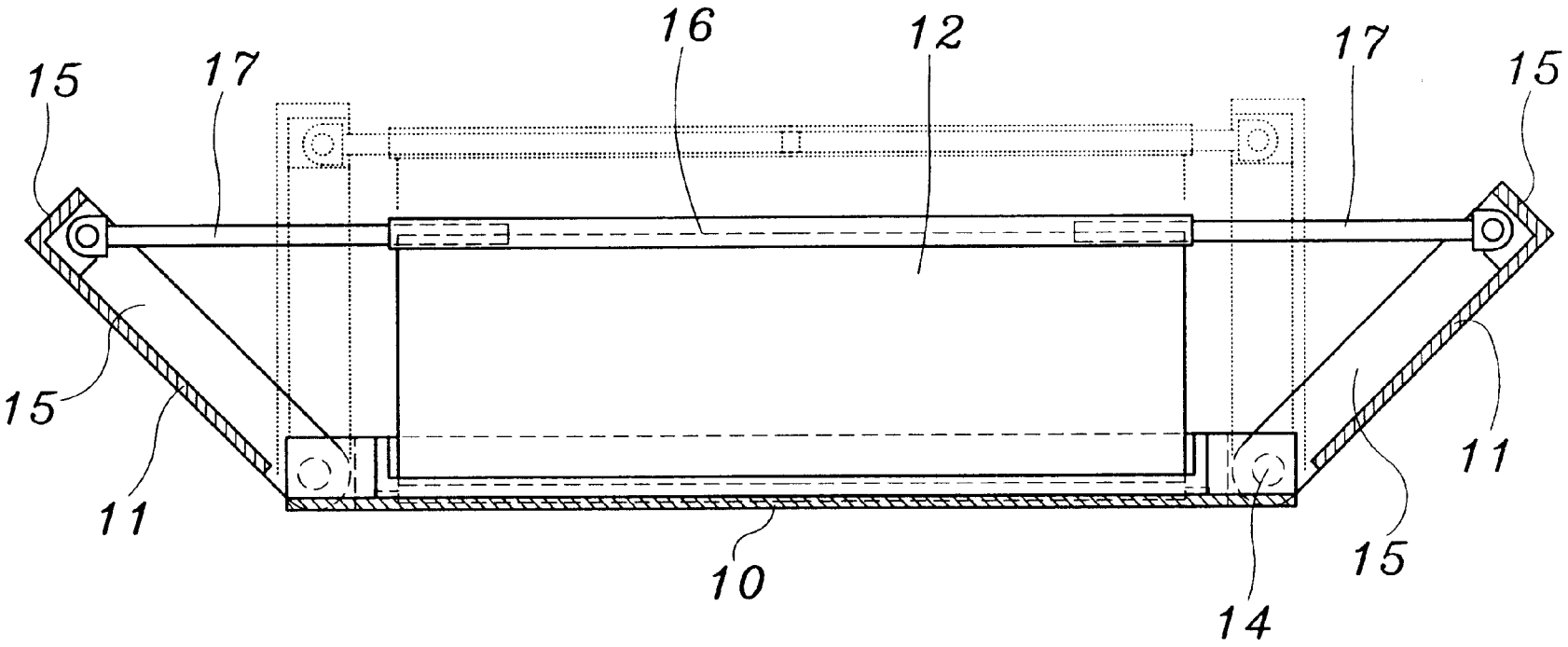
FIG. 7 is a schematic plan view of the present invention during assembly.

The second side plates 12 are formed from a flexible material. An upper end of each of the second side plates 12 is received in the receiving chamber 18 on either lateral side of the base plate 10. Means, such as a winding spring (not shown), can be disposed in the receiving chamber 18 to elastically wind up the second side plate 12 (as shown in FIG. 1). An upper end of the second side plate 12 is connected to an end rod 16. By moving the end rod 16 upwardly, the second side plate 12 in the receiving chamber 18 can be pulled upwardly (see FIGS. 7 and 8).

The end rod 16 has both ends, each of which is insertably connected to one end of a link 17. The other end of the link 17 is pivotally connected to a free end of the first side plate 11. When the two first side plates 11 are erected in a vertical position with respect to the base plate 10, i.e., in an assembled state (see FIG. 8), the links 17 can bring the two end rods 16 to displace upwardly to pull the second side plates 16 in the receiving chambers 18 upwardly so that the first and second side plates 11, 12 are erected on four sides of the base plate 10 to form a container having an opening at an upper end and a relatively great depth. When the two first side plates 11 caused to lie level with respect to the base plate 10 in an extended state (as shown in FIG. 1), the links 17 bring the two end rods 16 to displace downwardly so that the two second side plates 12 are wound downwardly into the receiving chambers 18. Hence, the first and second side plates 11, 12 are not erected on the four sides of the base plate 10. At this time, only the respective flanges 13, 15 of the base plate 10 and the first side plates 11 provide a stopping function and thereby form a container having a relatively small depth.

Figure 4:
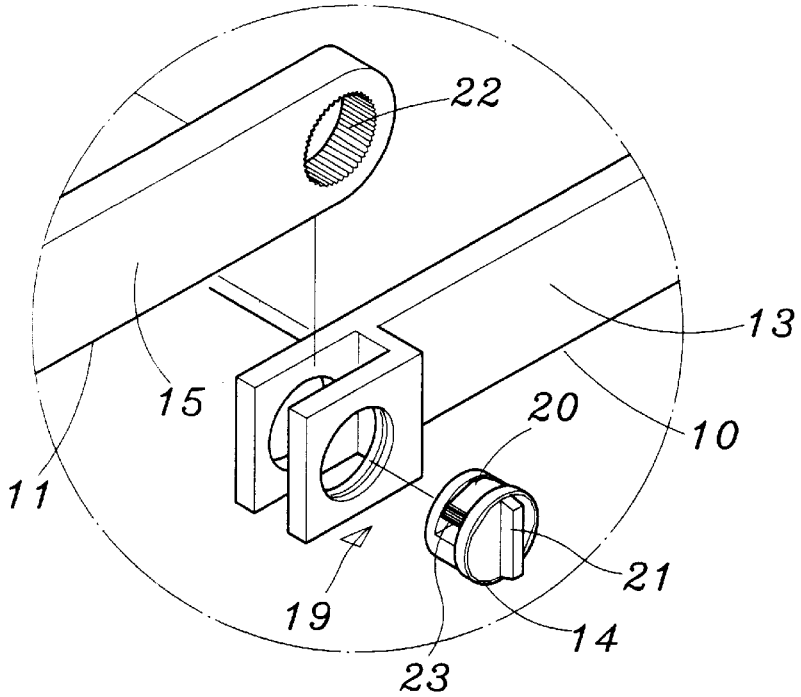
FIG. 4 is an exploded perspective view of a positioning mechanism of the present invention.
Figure 5:
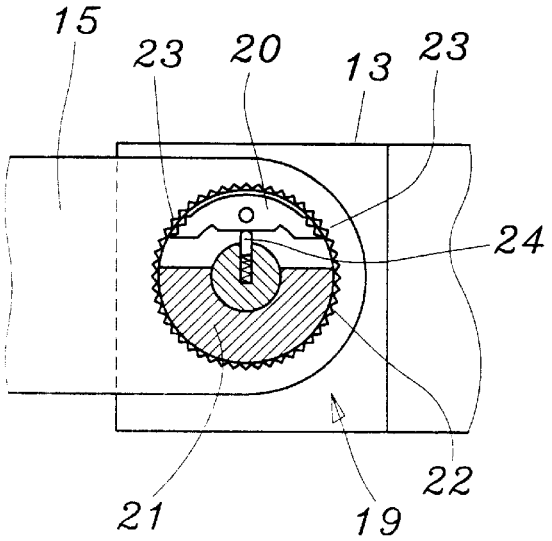
FIG. 5 is a schematic view of the positioning mechanism in a positioned state.
Figure 6:
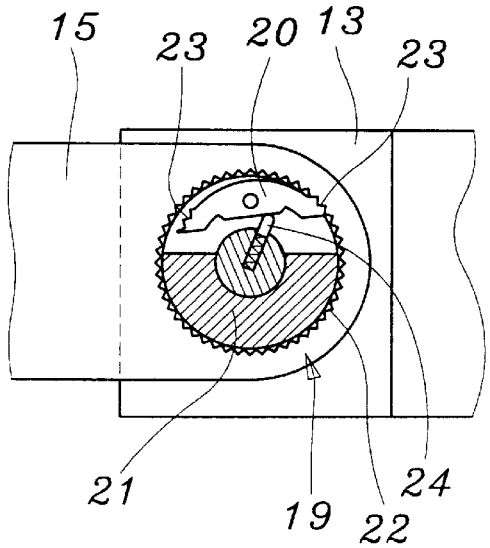
FIG. 6 is a schematic view of the positioning mechanism in an adjusted state.

Furthermore, when the first side plates 11 are erected in an assembled state, a positioning mechanism 19 (see FIG. 4) can be utilized to position the first side plates 11. The positioning mechanism 19 is provided between the flange 13 of the base plate 10 and the flange 15 of the first side plate 11, and includes a positioning element 20 and a knob 21 disposed on the pivot element 14, and positioning teeth 22 formed on the flange 15 of the first side plate 11. The pivot element 14 is secured on the flange 13 of the base plate 10. The knob 21 is rotatable on the pivot element 14. The positioning element 20 is pivotally provided on the pivot element 14, and has two ends integrally formed with positioning toothed portions 23. The positioning teeth 22 on the flange 15 of the first side plate 11 fit the outer periphery of the pivot element 14. The knob 21 is turnable so that an elastic urging pin 24 urges against the positioning element 20 to cause it to perform a swinging action, thereby causing the positioning toothed portion 23 on the positioning element 20 to engage the positioning teeth 22 on the flange 15 of the first side plate 11 (as shown in FIG. 4) so that the first side plates 11 are firmly positioned, or to disengage from the positioning teeth 22 (as shown in FIG. 5) so that the first side plates 11 are in an adjusted state.

In the present invention, the first and second side plates 11, 12 can be erected or extended as needed to allow flexible adjustment of the depth of the box assembly (container). The user can adjust the state of the box assembly according to needs. To facilitate displaying or removal of articles in the box assembly, the box assembly can be adjusted to have a smaller depth (as shown in FIG. 1). To facilitate carrying or moving of the box assembly, the first and second side plates 11, 12 can be erected so that the depth of the box assembly is greater (as shown in FIG. 8) to prevent articles contained in the box assembly from falling out.

In view of the foregoing, it can be appreciated that the present invention solves the problems of the prior art, in which shallow containers are inconvenient for carrying articles while deeper containers are not convenient for displaying or removal of articles.

Although the present invention has been illustrated and described with reference to the preferred embodiment thereof, it should be understood that it is in no way limited to the details of such embodiment but is capable of numerous modifications within the scope of the appended claims.

What is claimed is:

1. A foldable box assembly, comprising:

a base plate having two opposite lateral sides provided with receiving chambers, respectively;

two first side plates each having four sides, one side thereof being pivotally connected to two sides of said base plate;

two second side plates formed from a flexible material and being elastically wound up in said two receiving chambers of said base plate, said second side plates each having an upper end connected to an end rod, said end rod having two ends each being connected to one end of a link, said link having the other end pivotally connected to a free end of a respective one of said first side plates; and a positioning mechanism provided between said base plate and said first side plates, adapted for controlling said first side plates to be positioned in an assembled state or in an adjustable state.

2. The foldable box assembly as defined in claim 1, wherein said first side plates are pivotally connected to said lateral sides of said base plate by pivot elements.

3. The foldable box assembly as defined in claim 2, wherein said positioning mechanism includes positioning elements and knobs provided on said pivot elements, and positioning teeth formed on said first side plates, said positioning elements being provided with positioning toothed portions, said knob being turnable to bring said positioning toothed portions of said positioning elements to engage or disengage from said positioning teeth on said first side plates such that said first side plates can come to a positioned state or an adjusted state.

4. The foldable box assembly as defined in claim 1, wherein said opposite lateral sides of said base plate and the other three sides of each of said first side plates are formed with flanges.

5. The foldable box assembly as defined in claim 1, wherein said first side plates are provided with handles to facilitate carrying.

* * * * *